US005924322A

United States Patent [19]

Caveney

[11] Patent Number: 5,924,322

[45] Date of Patent: Jul. 20, 1999

[54] MULTIPLE POSITION LOCATOR FOR CRIMPING TOOLS

[75] Inventor: Jack E. Caveney, Hinsdale, Ill.

[73] Assignee: Panduit Corp., Tinley Park, Ill.

[21] Appl. No.: 08/951,899

[22] Filed: Oct. 16, 1997

[51] Int. Cl.[6] ..... H01R 43/042

[52] U.S. Cl. ..... 72/409.14; 72/461; 29/751

[58] Field of Search ..... 72/409.14, 409.13, 72/409.1, 461, 409.01; 29/751

[56] References Cited

U.S. PATENT DOCUMENTS

| | | | |
|---|---|---|---|
| 2,829,549 | 4/1958 | Demler | 29/751 |
| 3,457,764 | 7/1969 | McKee | 72/409.01 |
| 3,504,417 | 4/1970 | Filia | 72/409.14 |
| 3,525,107 | 8/1970 | Hays | 72/409.13 |
| 3,673,848 | 7/1972 | Filia . | |
| 3,710,611 | 1/1973 | Filia . | |
| 4,055,980 | 11/1977 | Churla | 72/416 |
| 4,630,462 | 12/1986 | Wiener et al. | 29/751 |
| 4,736,614 | 4/1988 | Fryberger | 29/751 |
| 5,138,864 | 8/1992 | Tarpill | 29/751 |

*Primary Examiner*—Daniel C. Crane
*Attorney, Agent, or Firm*—Mark D. Hilliard; Robert A. McCann; Michael J. Turgeon

[57] ABSTRACT

A locator for use with a crimping tool including a first slot for seating and aligning slot blade terminal type connectors and a second slot for seating and aligning female disconnect type connectors whereby the locator is rotatable between these two positions and a third open position.

10 Claims, 4 Drawing Sheets

MULTIPLE POSITION LOCATOR FOR CRIMPING TOOLS

TECHNICAL FIELD

The present invention relates to a crimping tool, and more particularly to a crimping tool for electrical terminals and disconnects, which includes a locator for providing receptacle and accurate alignment for crimping a variety of types of connectors.

BACKGROUND OF THE INVENTION

A wide variety of crimping tools are well known and include various mechanisms whereby the forces applied to the handles of the tool are converted into the crimping pressure on a variety of electrical terminals, disconnects and splices. The terminals are generally of the flat blade type such as a ring or fork terminal or of the female disconnect type having outer walls curled inside so as to define an opening for receiving a flat male tab. It has been known to use a terminal locator on a crimping tool for properly aligning the barrel portion of a flat blade terminal connector with the crimp dies. The locator includes a narrow slot sized so the flat end portion of the terminal passes through the slot and the locator acts as a stop to the barrel portion to properly align the barrel for crimping. The locator also acts as a wire stop for these flat blade terminals. In the field, however, when an electrical connector other than a flat blade terminal is to be crimped, the locator needs to be moved out of position to allow the female disconnect or other larger terminal to be crimped. Therefore, without any locator to seat the crimp barrel, the possibility for a poor crimp is increased.

SUMMARY OF THE INVENTION

It is therefore, an object of the present invention to provide an improved locator for use with an electrical terminal crimping tool.

It is another object of the invention to provide a locator which has a plurality of alignment slots selectively rotatable for properly locating flat blade terminals and female disconnects respectively.

DESCRIPTION OF THE PREFERRED EMBODIMENT

Figure 1:
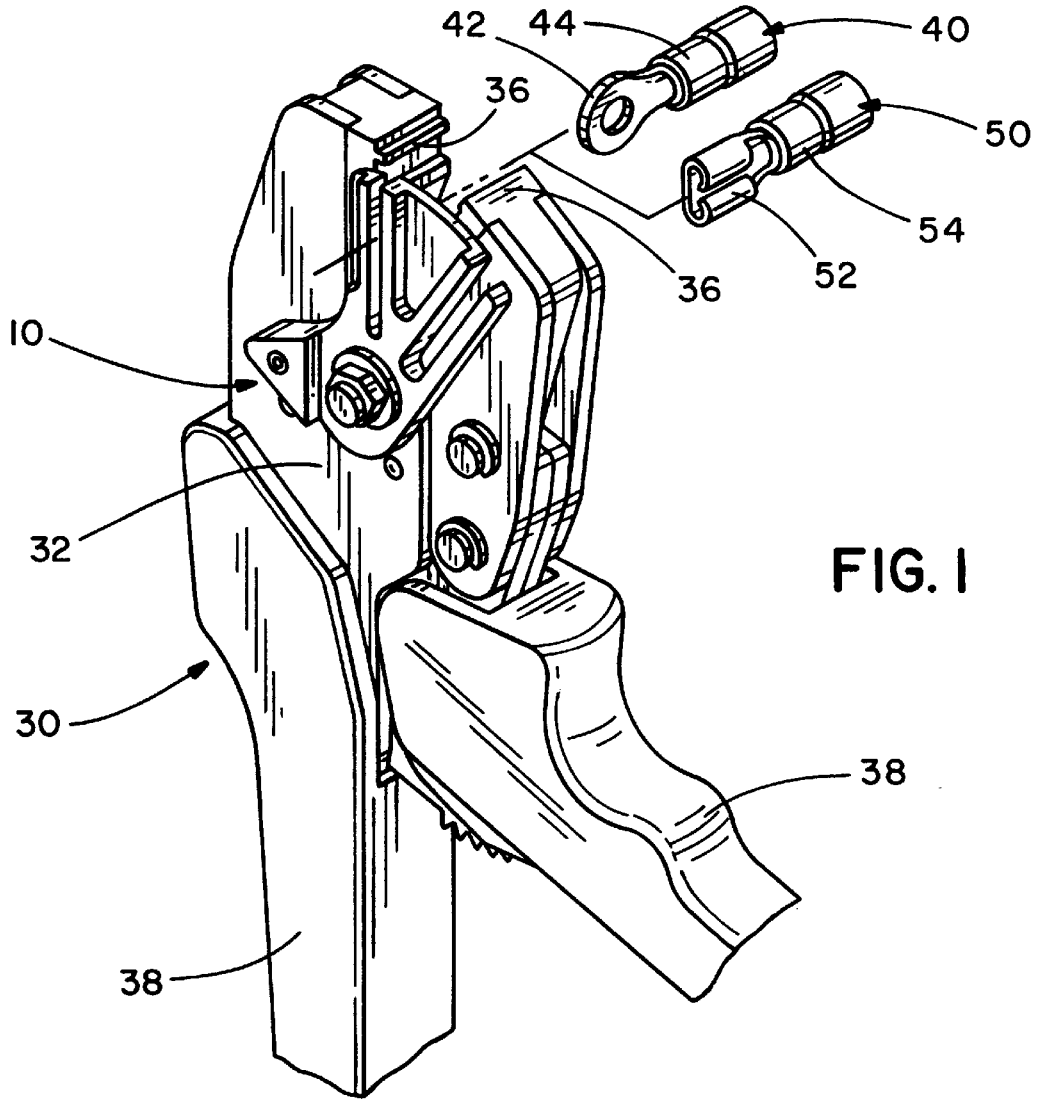
FIG. 1 is a perspective view of a crimping tool including a multiple position terminal locator of the present invention.
Figure 2:
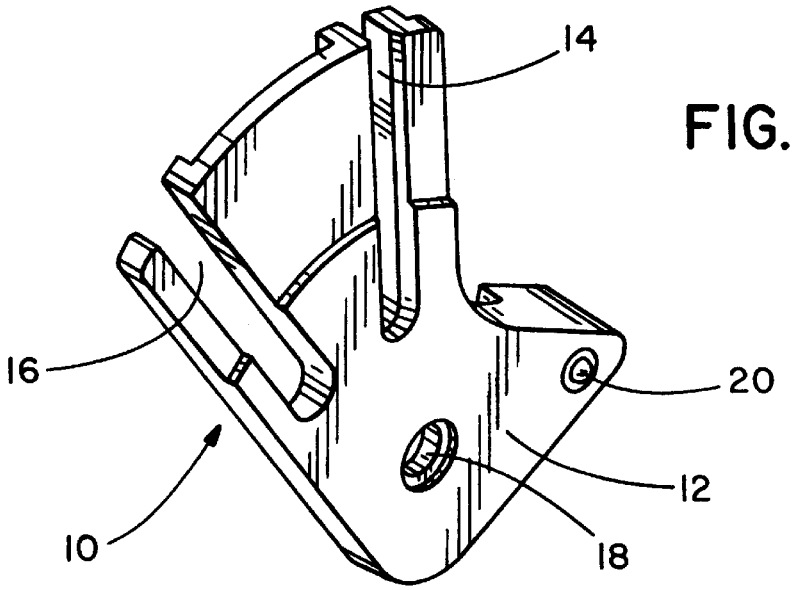
FIG. 2 is a perspective view of a tool side of the terminal locator of FIG. 1.
Figure 3:
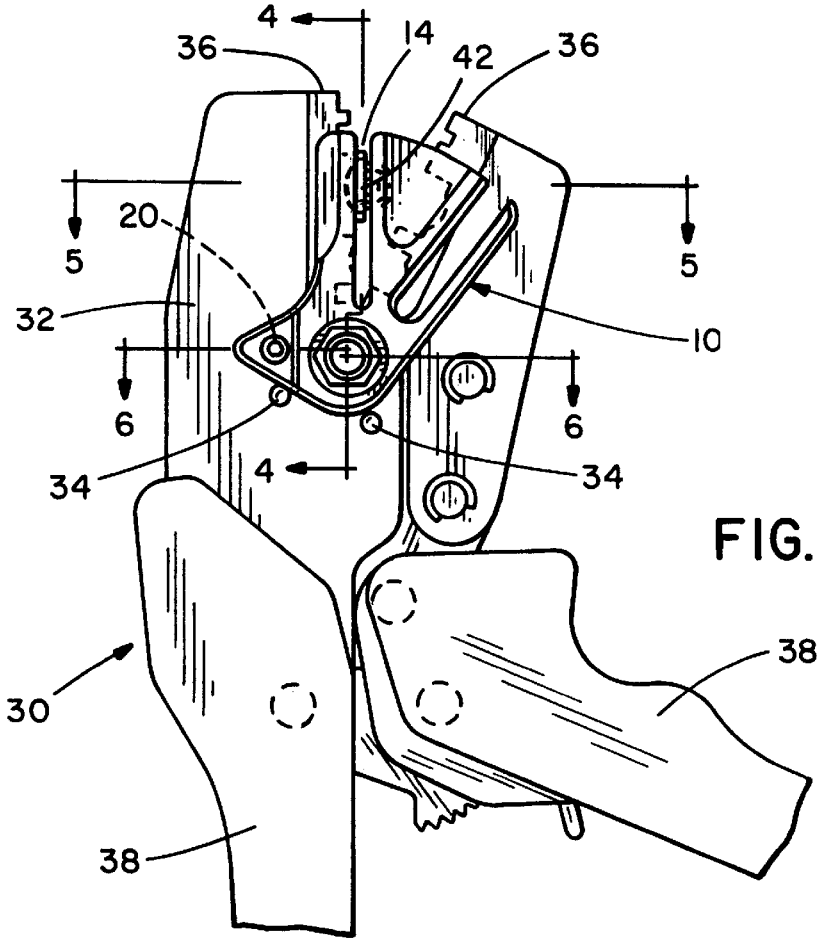
FIG. 3 is a side sectional view of the crimping tool of FIG. 1 shown in the open position.
Figure 4:
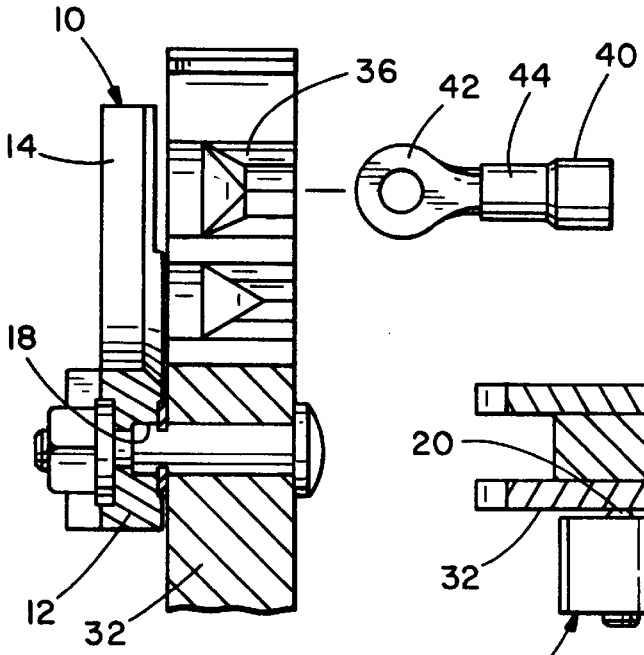
FIG. 4 is a sectional view through the crimping tool of FIG. 1 taken along lines 4—4 of FIG. 3.
Figure 5:
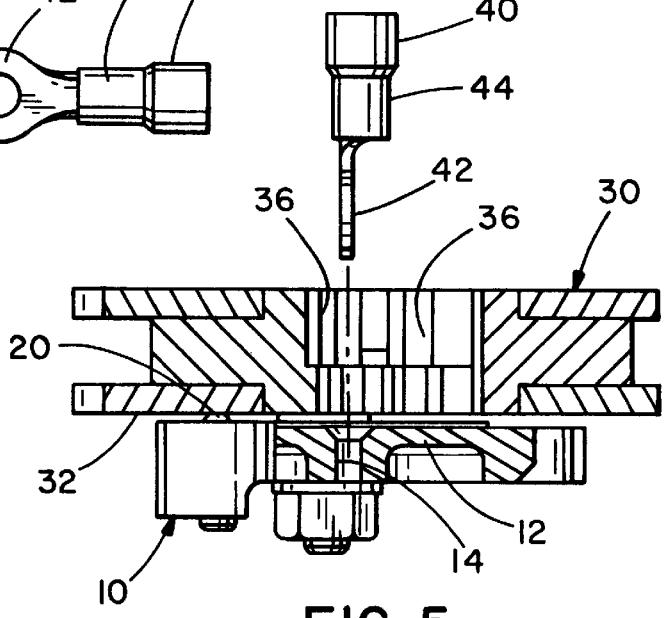
FIG. 5 is a sectional view taken along lines 5—5 of FIG. 3.
Figure 6:
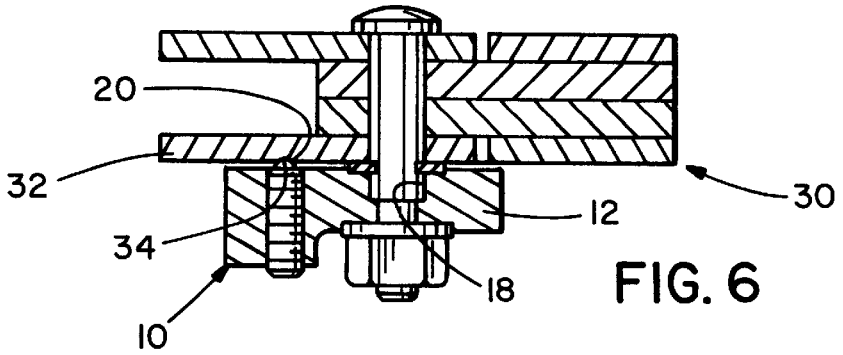
FIG. 6 is a sectional view taken along lines 6—6 of FIG. 3.
Figure 7:
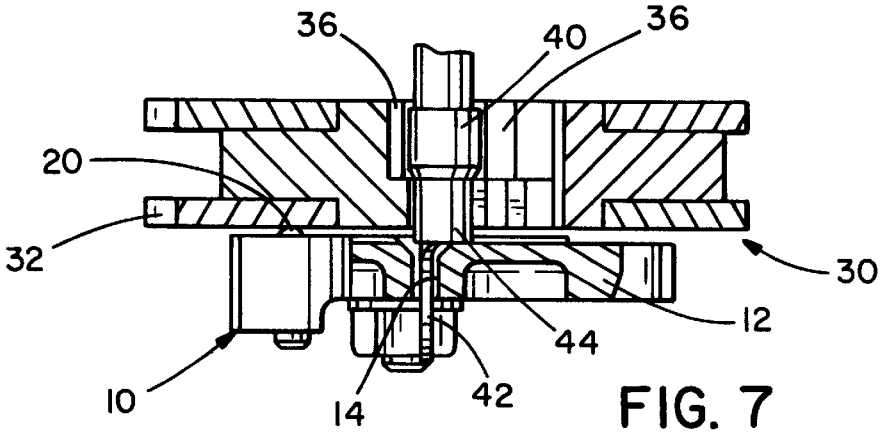
FIG. 7 is a sectional view taken along lines 7—7 of FIG. 1.
Figure 8:
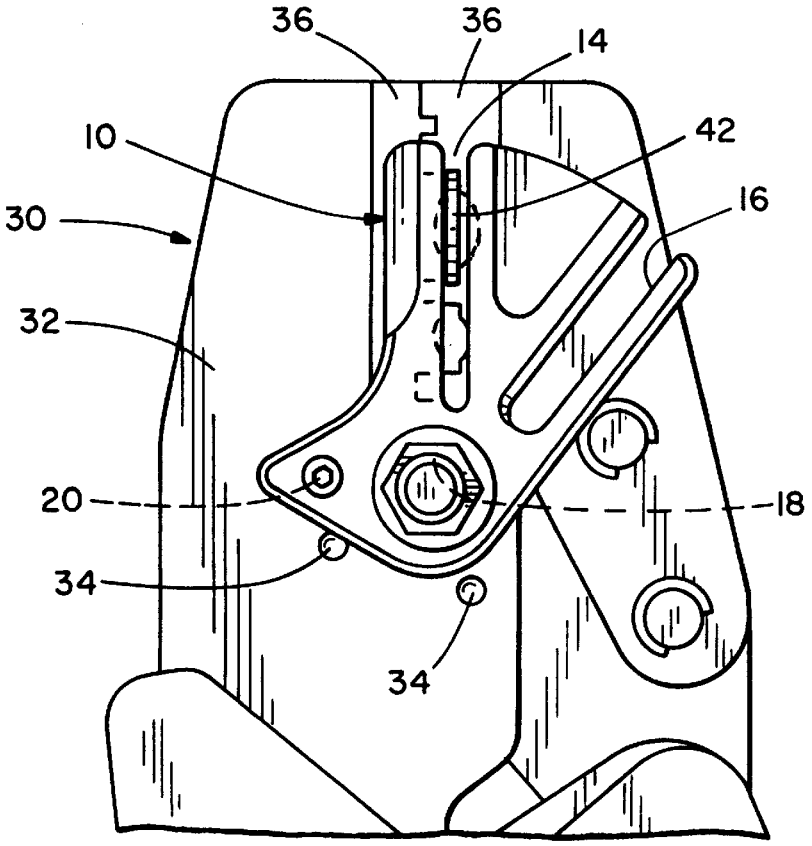
FIG. 8 is a side view of the crimping tool of FIG. 3 shown in the crimping position.

A locator embodying the concept of the present invention is shown on a terminal crimping tool and designated generally by the reference numeral 10 in the accompanying drawings. The crimping tool 30 generally includes a pair of handles 38 and a tool frame 32 that supports a pair of generally opposed crimp dies 36. The crimp dies 36 can be designed to form a variety of crimp pockets for crimping different sizes of terminals. As shown in FIGS. 1 and 2, locator 10 is mounted on a tool frame 32 of a crimping tool 30 and is comprised of a metal plate 12 including a flat blade terminal slot 14, a female disconnect slot 16 and a tool engaging hole 18. The locator 10 is mounted adjacent the crimp die 36 of crimp tool frame 32 and is rotatable between positions aligning the terminal slot 14 or disconnect slot 16 with the crimp area as well as to an open position in which neither slot is aligned with the crimp area. The locator 10 includes a detent bump 20 which engages with one of the detent recesses 34 formed on tool frame 32 for setting the locator 10 in the appropriate position.

As can be seen in FIGS. 3–8, when crimping a flat blade terminal 40, the terminal 40 is inserted between a pair of crimp dies 36 while the tool frame 32 and handles 38 are in the open position. The terminal end 42 passes through terminal slot 14 until the crimping barrel 44 seats against the locator 10 which assures proper crimp barrel alignment of the terminal 40 between the crimp dies 36 of tool 30. The terminal slot 14 is sized so as to correspond in size to the flat blade portion 42 of the terminal to allow passage but to avoid having too much play that could result in improper crimp alignment. The terminal slot 14 extends for the length of the crimp area. Therefore, upon closing the tool handles 38 and applying the crimping force, the crimp barrel 44 is crimped onto the wire (not shown).

Figure 9:
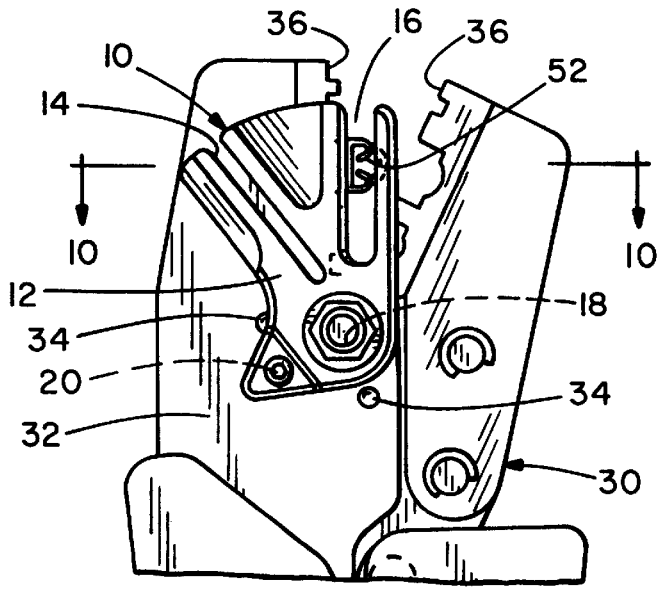
FIG. 9 is a sectional view of the crimping tool shown with a disconnect.
Figure 10:
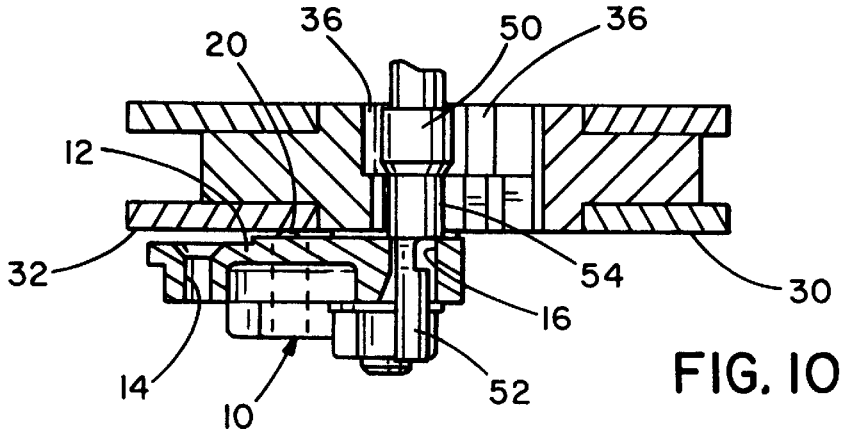
FIG. 10 is a sectional view taken along lines 10—10 of FIG. 9.
Figure 11:
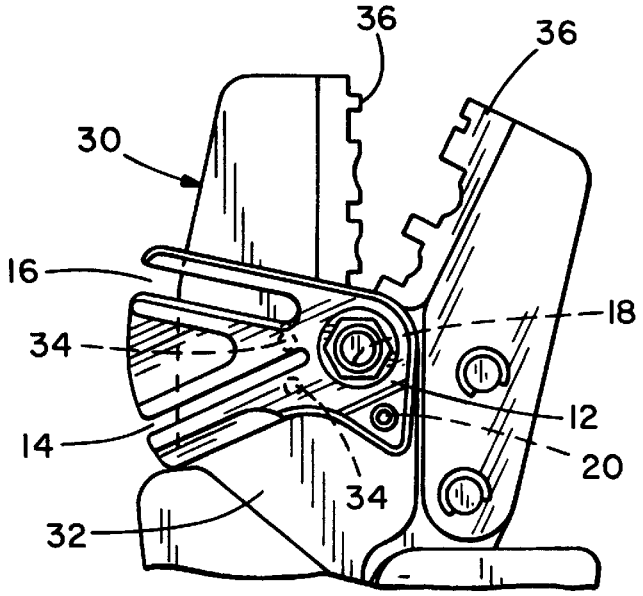
FIG. 11 is a side view of the tool with the locator in the open position.

As best seen in FIGS. 9–10, when the user is crimping female disconnects 50 which have curled ends that define a deeper connector end 52, the locator 10 is rotated into a second position in which the disconnect slot 16 is aligned with the crimping area and the same crimping operation is performed. The disconnect end 52 is inserted through the disconnect slot 16 until the crimping barrel 54 seats against the locator 10 which assures a proper crimp barrel alignment. The disconnect slot 16 is sized so as to correspond in size to the female disconnect to allow passage but to avoid having too much play that could result in an improper crimp alignment and extends for the entire length of the crimp area. If the user is applying a crimp to a wire joint or butt splice (not shown) which requires even more space, the locator 10 can be moved to the open position as shown in FIG. 11.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical terminal crimping tool comprising:

a pair of handles;

a tool frame attached at one end of the pair of handles for supporting a pair of crimp dies which define a crimp area having at least one crimp pocket; and a locator secured to the tool frame adjacent the crimp area, wherein the locator includes a plurality of radially extending slots extending the length of the entire crimp area and circumferentially spaced from one another wherein the locator is rotatable between positions aligning each slot with the crimp area and each of said slots being sized to receive at least a portion of an electrical terminal.

2. An electrical terminal crimping tool according to claim 1, wherein there are two slots.

3. An electrical terminal crimping tool according to claim 2, wherein one slot is narrower.

4. An electrical terminal crimping tool according to claim 1, wherein the locator includes detent means for selectively positioning the locator with respect to the crimp area.

5. An electrical terminal crimping tool according to claim 1, wherein the locator can be positioned with none of the slots in alignment with the crimp area.

6. A crimping tool comprising:

a pair of handles;

a tool frame attached at one end of the pair of handles for supporting a pair of crimp dies which define a crimp area having at least one crimp pocket; and a locator secured to the tool frame, wherein the locator includes a plurality of radially extending slots, each slot extending along a different radius, wherein the locator is movable such that each slot can be independently and selectively aligned with the crimp area and each of said slots being sized to receive at least a portion of an electrical terminal.

7. An electrical terminal crimping tool according to claim 6, wherein there are two slots.

8. An electrical terminal crimping tool according to claim 7, wherein one slot is narrower.

9. An electrical terminal crimping tool according to claim 6, wherein the locator includes detent means for selectively positioning the locator with respect to the crimp area.

10. An electrical terminal crimping tool according to claim 6, wherein the locator can be positioned with none of the slots in alignment with the crimp area.

* * * * *